United States Patent [19]

Rosenberg et al.

[11] 3,937,314

[45] Feb. 10, 1976

[54] GUMBALL BANK DISPENSING MECHANISM

[76] Inventors: Phillip I. Rosenberg, 285 Linden Park Place; Mervyn L. Keces, 505 Groveland, both of Highland Park, Ill. 60035

[22] Filed: Sept. 5, 1974

[21] Appl. No.: 503,353

[52] U.S. Cl. ..... 194/63

[51] Int. Cl.[2] ..... G07F 11/00

[58] Field of Search..... 194/61, 63, 62, 64–66

[56] References Cited

UNITED STATES PATENTS

| | | | |
|---|---|---|---|
| 2,784,827 | 3/1957 | Jenkins et al. | 194/61 |
| 3,010,557 | 11/1961 | Weitzman | 194/63 |
| 3,189,152 | 6/1965 | Weitzman | 194/61 X |

*Primary Examiner*—Allen N. Knowles
*Attorney, Agent, or Firm*—Gerald S. Geren

[57] ABSTRACT

There is disclosed herein a dispensing mechanism for use in gumball machines which includes coin-receiving and gumball-delivering mechanisms that permit dispensing of gumballs when the coin-receiving mechanism is operated with a coin therein, and prevent dispensing when no coin is present. These mechanisms are suitable for manufacture from plastic and the coin-receiving mechanism includes a rotatable coin-receiving element having an axially-extending, anti-reversing abutment shoulder which cooperates in preventing reverse rotation of the element. A coin slot engaging dog is also provided which engages the trailing edge of the coin slot when the coin-receiving element is rotated forwardly with no coin in the slot, thereby preventing dispensing. When a coin is in the slot, the dog is disabled and forward rotation of the coin-receiving element is permitted which permits dispensing of a gumball.

12 Claims, 10 Drawing Figures

FIG. 1
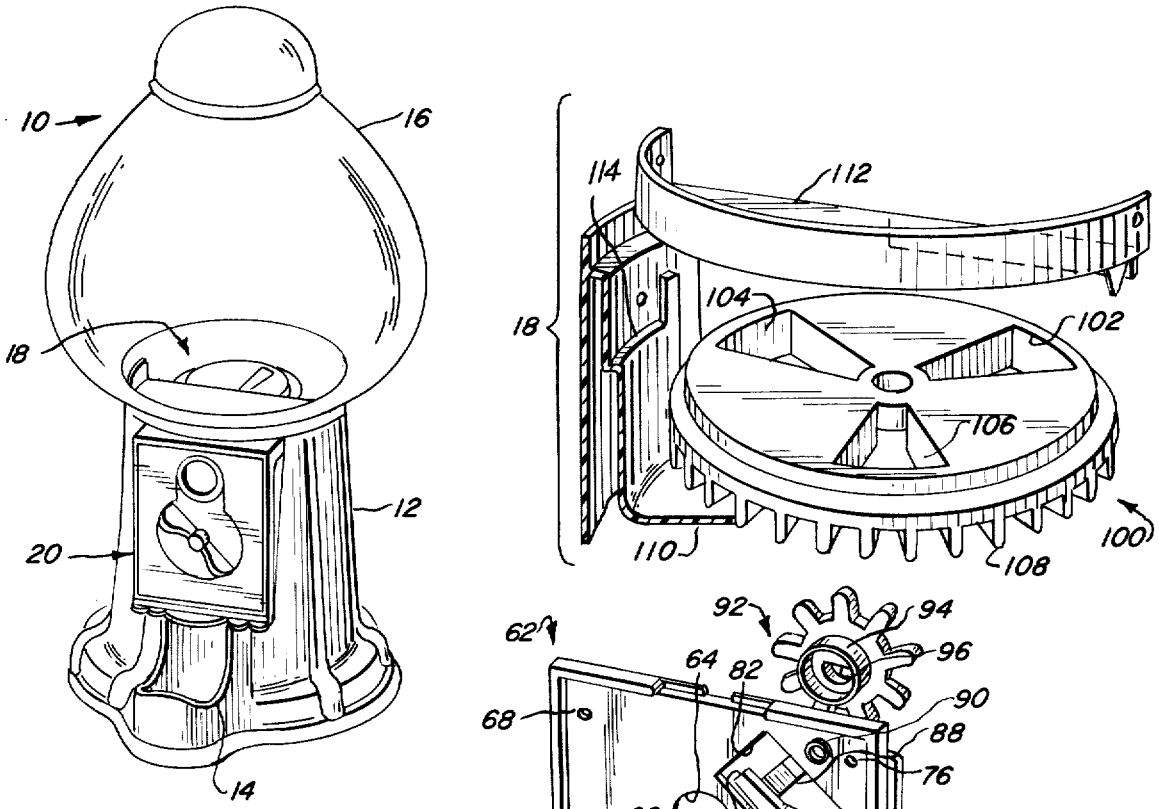
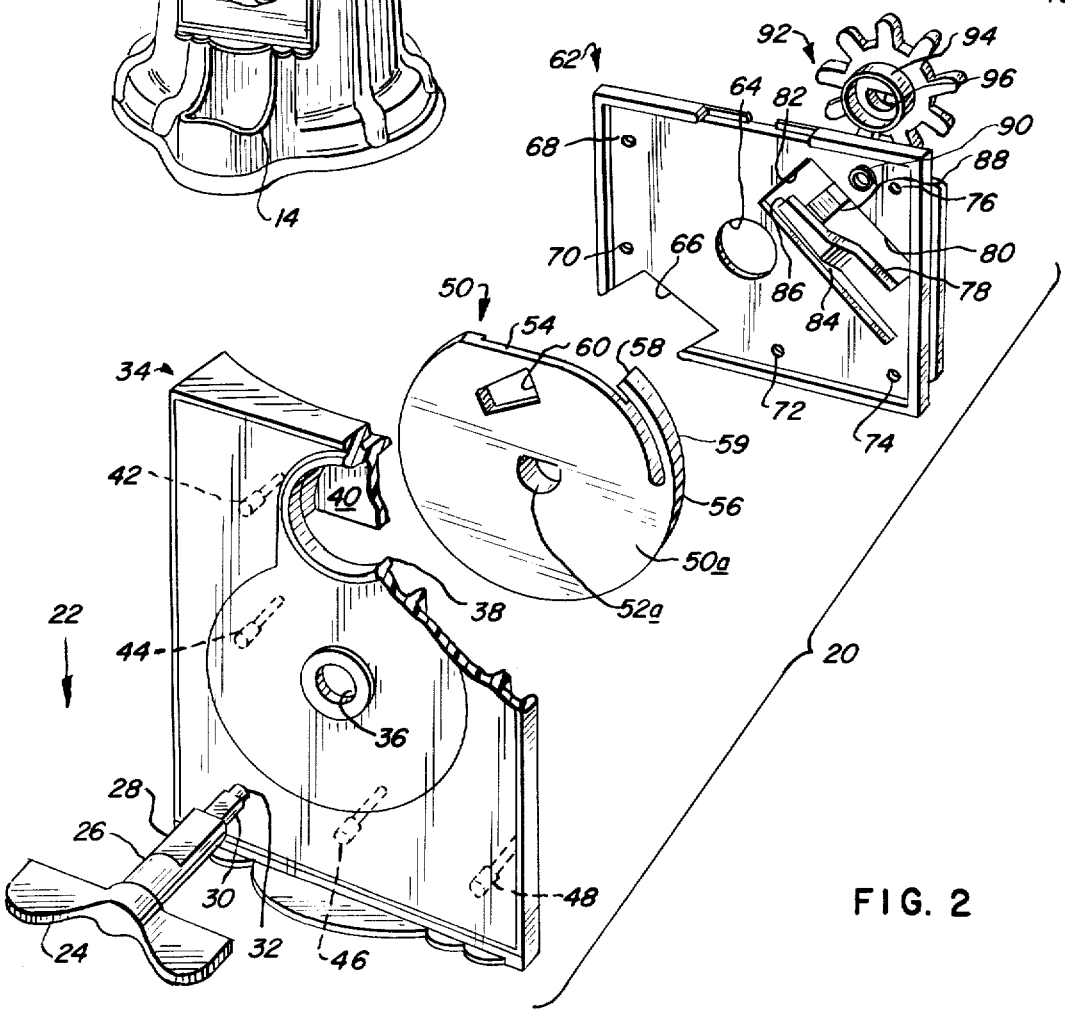
FIG. 2

GUMBALL BANK DISPENSING MECHANISM

BACKGROUND OF THE INVENTION

This invention relates to dispensing mechanisms for vending machines; and in particular gumball banks.

Gumball machines and gumball banks are popular items for home use. For example, small toy plastic gumball banks of the type disclosed in U.S. Pat. No. D158,529 have received wide acceptance. On the other hand, the commerical, metal-type gumball machine is only occasionally found in a home because such machines are prohibitively expensive. Recently, Oak Manufacturing Co. of California has introduced a large, metal, relatively expensive, antique-styled gumball machine for home use. In view of the wide acceptance of the toy plastic gumball banks, it was decided that a large plastic bank should be made available for home use.

It is, therefore, an object of the invention to provide a comparatively inexpensive, large, plastic gumball bank or machine for the home or consumer market.

The large, metal, gumball bank has features such as the dispensing mechanism similar to the well-known commercial metal gumball machines. Such mechanisms are disclosed in U.S. Pat. Nos. 3,010,557; 3,064,789; and 3,289,152.

The dispensing mechanisms include coin-receiving mechanisms having means for preventing operation of the machine by preventing both forward and reverse rotation of the operator handle if no coin has been inserted while permitting operation and forward rotation of the operator handle after a coin has been inserted. One variation of this mechanism includes the ability to receive multiple coins and of different sizes and means for disabling the mechanism when such coins are not present. However, these mechanisms are: (1) complex in that they have been designed to withstand vandalism; (2) heavy-duty in that they must be reliable over long periods of constant usage; (3) require a substantial number of parts; and (4) expensive to manufacture.

The recently-introduced consumer-oriented metal machines have features shown in the above-identified patents. In this machine the coin-receiving mechanism includes a slotted, rotatable, metal, coin-receiving disc having a ratchet teeth about its periphery and a reverse rotation preventing system which includes a separate metal dog that is biased into the engagement with the ratchet teeth by a separate spring so as to prevent reverse rotation of the disc but to permit forward rotation thereof. The forward rotation preventing mechanism includes a second metal dog which is mounted rearwardly of the disc and biased so as to press against one side of the disc. When no coin is in the coin-receiving slot, the second dog can engage the trailing edge of the slot and thereby prevent forward rotation; while when there is a coin in the slot the second dog is disabled thereby permitting rotation.

In the design of the large plastic machine, it was apparent that coin-receiving mechanisms of the type used in the small plastic bank were unsuitable and that mechanisms of the type used in the metal machines were too expensive and required too many parts.

it is, therefore, another object of this invention to provide a coin-receiving mechanism for use in a large, consumer-oriented plastic gumball machine which can be inexpensively manufactured of plastic, includes a few parts and provides forward and reverse rotation prevention features.

SUMMARY OF THE INVENTION

There is provided by this invention an inexpensive, reliable, readily-manufactured dispensing mechanism having a coin-receiving mechanism which can, in substantial part, be fabricated from a few plastic parts and which is suitable for use in consumer-purchased large plastic banks. The mechanism includes the forward and reverse rotation prevention features as well as being capable of operation with coins of different denominations.

The coin-receiving mechanism includes a rotatable coin-receiving disc having an axially-extending abutment shoulder for cooperating in preventing reverse rotation of the disc. A second shoulder is provided in fixed relation to the disc and is arranged for engagement by the abutment shoulder of the disc so as to prevent reverse rotation of the disc beyond a predetermined point.

BRIEF DESCRIPTION OF THE DRAWINGS

FIG. 1 is a perspective view of a gumball bank;

FIG. 2 is an exploded front perspective view showing the dispensing mechanism for a bank of the type shown in FIG. 1;

in FIG. 4, the operation of the anti-reversing mechanism; in FIG. 5, the operation of forward rotation preventing mechanism; and in FIG. 5 a coin in position disabling the forward rotation prevention mechanism; and in FIG. 6 discharge of the coin from the mechanism.

DESCRIPTION OF THE PREFERRED EMBODIMENT

Figure 3:
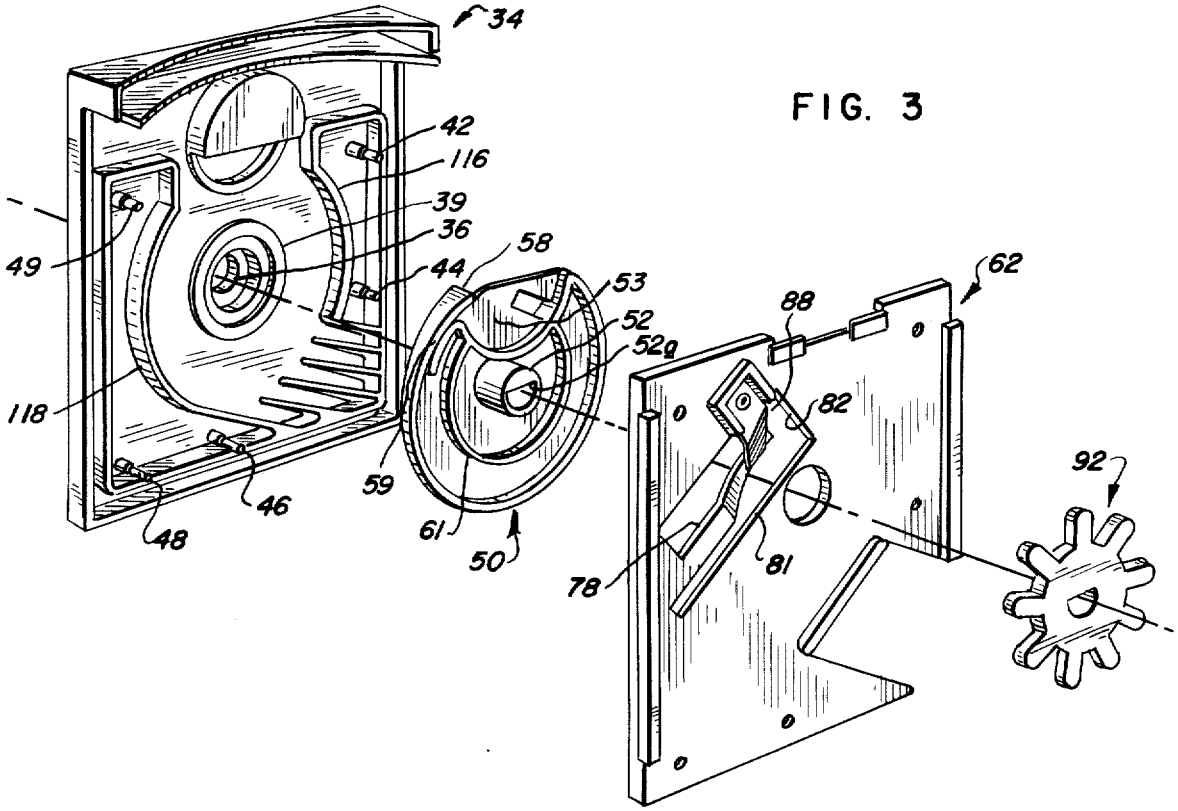
FIG. 3 is an exploded rear perspective view of the basic elements of the coin-receiving mechanism.

Referring now to the drawings there is shown a gumball machine 10, generally, which includes a base 12 having a discharge opening 14 in the front thereof and a globe-type gumball reservoir 16 that is carried by the base. The base also supports the delivery mechanism 18 and the coin-receiving mechanism 20 for controllably dispensing gumballs or other similar articles.

Coin-Receiving Mechanism

The coin-receiving mechanism 20 is a subassembly which is inserted into the base during assembly of the machine. The delivery mechanism 18 is then fitted onto the base over the coin-receiving mechanism and the globe thereover.

Referring now to FIG. 2, the coin-receiving mechanism 20 and delivery mechanism 18 are shown. The coin-receiving mechanism subassembly 20 includes an actuator 22, a front plate 34, a coin-receiving disc or element 50, a back plate 62 and a spur gear 92 which are assembled and held together in a sandwich-like arrangement.

The actuator 22 is a plastic member which includes: a handle 24 and a shaft 26. The shaft includes: a coin-receiving disc engaging land 28; a reduced diameter section having a spur gear engaging land 30; and a heat-deformable tip 32.

The front plate 34 is a plastic member and has a central aperture 36 through which the actuator shaft 26 extends and a coin-receiving aperture 38 spaced thereabove. The coin-receiving aperture includes a flat back section 40 for assuring alignment of the coin in a plane parallel to the front plate. A plurality of alignment and heat-deformable pins or guideposts 42, 44, 46, 48 and 49 are provided on the back side of the front plate for supporting the back plate of the mechanism and for holding the subassembly together. A raised spacer boss 39 is provided on the back side of the front plate, surrounds the central aperture 36 and extends inwardly for maintaining the disc 50 in spaced axial relation to the front plate. Raised spacerribs such as 116 and 118 are also provided on the back of the front plate so as to space the back plate 62 at a predetermined distance from the front plate. The ribs 116 and 118 also define a somewhat circular recess into which the disc 50 fits.

The rotatable coin-receiving element or disc 50 is a molded plastic member and has a central boss 52 through which there is provided a keyway 52*a*. The actuator shaft land portion 28 extends through the keyway so that the rotation of the actuator handle 24 causes rotation of the disc. The front face 50*a* of the disc is flat and when assembled, this face engages the spacer boss 39. The disc also has a flat peripheral portion 54 below which is positioned a coin-receiving slot or pocket 53.

An arcuate peripheral finger-like member 56 is provided on the disc adjacent the pocket 53. The finger includes an end or shoulder portion 58 which defines an anti-reversing abutment shoulder that extends axially inwardly and cooperates in preventing reverse rotation (i.e., counter-clockwise rotation) of the coin-receiving element beyond a predetermined point. This point is usually arranged such that the pocket 53 and aperture 38 can be aligned. On the outward side the finger is flat and on the inner side the finger has a cam-like tapered portion 59 which extends from the disc body to the shoulder 58. The finger is also sufficiently flexible that it can be flexed outwardly.

An aperture 60 is provided in the disc pocket 53 and cooperates in preventing forward (i.e., clockwise) rotation of the element 50 when no coin is present in the slot. An inner circular rib 61 is provided on the inner face of the disc and acts as a guide.

The back plate member 62, which is also of plastic, has a central aperture 64 through which the shaft 26 extends and which surrounds the boss 52. The lower cut-out portion 66 defines a discharge chute so that a coin can be discharged from the slot in the coin-receiving element into a coin-receiving reservoir. Five guidepost receiving apertures 68, 70, 72, 74 and 76 are provided for cooperation with the guideposts on the back of the front plate for assembling the subassembly. For example, the guidepost 42 extends through the aperture 68. When the front plate 34, the disc element 50 and the back plate 62 are assembled, the tips of each of the guideposts are heat-deformed so as to secure the three pieces in closely-spaced relation.

A coin-slot engaging dog or finger 78 is integral with the plate 62 and is positioned in an elongated aperture-like portion 81, one edge of which defines an anti-reversing abutment edge 82 which is adapted for engagement by the peripheral anti-reversing abutment shoulder 58 when the disc is rotated in the counter-clockwise or reverse direction. The edge 82 is so positioned to cooperate with the shoulder 58 in positioning the coin-receiving pocket 53 below the coin-receiving aperture 38 so as to assure proper entry of a coin into the pocket or slot.

The slot-engaging dog 78 is shaped so that its end portion 84 and tip 86 are bent outwardly toward the disc 50 and a biasing leaf spring 88 is secured to the back plate by rivet 90 to bias the end portion 84 and tip into the coin-receiving slot. The aperture 60 provides additional abutment surface along its edge for engagement by the terminal edge portion.

The last element of the coin-receiving mechanism is a spur gear 92 which has an apertured hub portion 94 that engages the back of the plate 62 and holds the gear teeth in spaced relation thereto. The land 30 of the actuator extends through the gear aperture 96 and, when the entire mechanism is assembled, the tip 32 of the shaft extends beyond the back side of the spur gear 92 and is heat-deformed so as to secure the gear 92 and actuator 22 in a spaced relation to each other on opposite sides of the coin-receiving mechanism.

Delivery Mechanism

The delivery mechanism 18 includes a dispensing disc 100 which has three triangularly shaped gumball-delivery apertures 102, 104 and 106, and a plurality of circumferential gear teeth 108. The disc rests on a transverse wall 110 of the base unit 12 and is journaled thereto. A semi-circular blocking segment 112 is positioned slightly above the disc 100 in the retaining groove 114 which is molded into the base 12. This segment directs gumballs from the reservoir to those apertures in the dispensing disc which are exposed. Gumballs fall into the apertures and as the dispensing disc 100 is rotated they are moved below the segment 112 to a position where they drop into the entry end of a chute which extends behind the coin-receiving mechanism 20 to the discharge opening 14.

Operation

Figure 8:
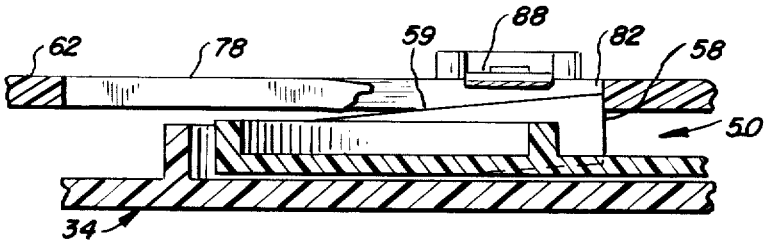
FIGS. 8, 9 and 10 are sectional views taken substantially along lines 8—8, 9—9 and 10—10 of FIGS. 4, 5 and 6, respectively, showing the operation of the forward and reverse rotation preventing mechanisms.
Figure 4:
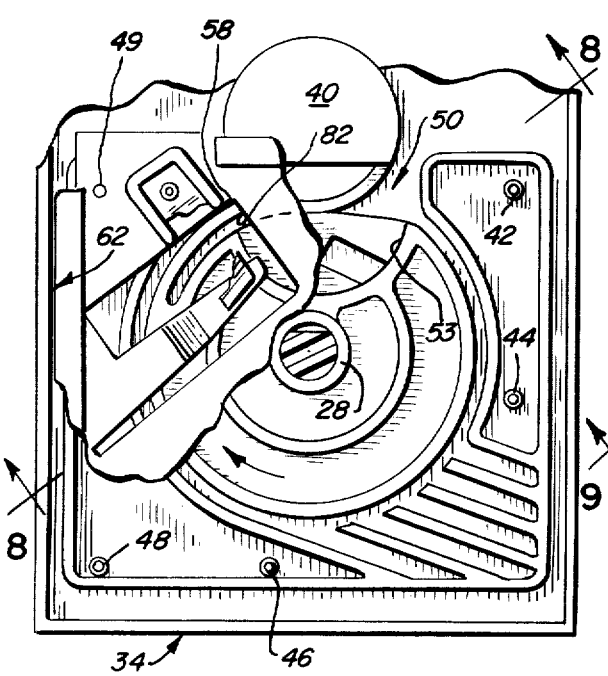
FIGS. 4 through 7 inclusive, are fragmentary rear elevational views of the coin-receiving mechanism showing.

The operation of the anti-reversing mechanism is seen best in FIGS. 4 and 8 where the shoulder 58 is shown in abutting engagement with the edge 82 which thereby prevents any reverse rotation of the disc 50 and aligns the slot 53 with the aperture 38. As can be seen, this will be true whether or not there is a coin present in the slot 53.

Figure 9:
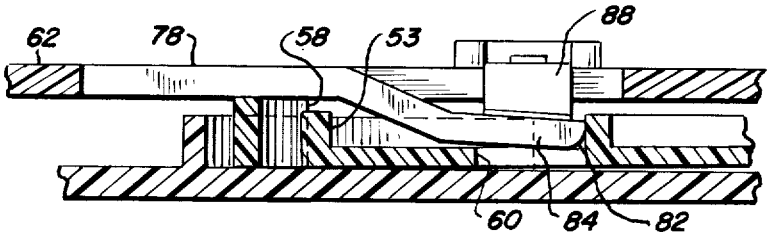
Figure 5:
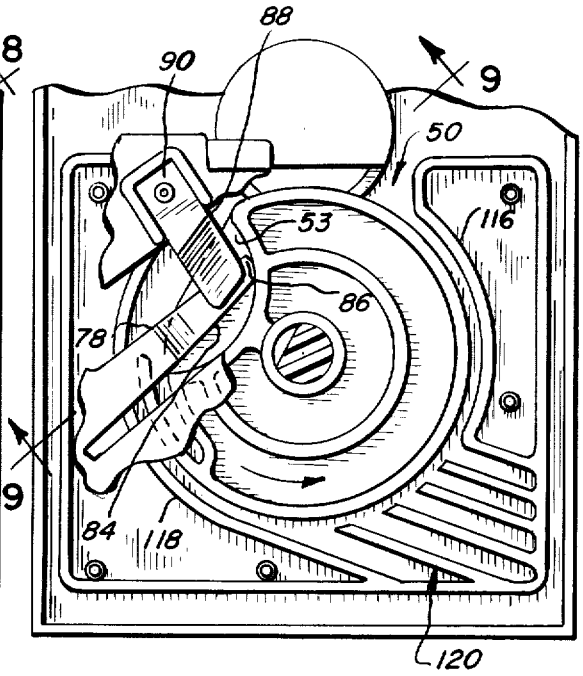

Referring to FIGS. 5 and 9, it is seen that disc 50 is being rotated in the forward direction without a coin in the slot 53. The finger 78 and in particular the terminal portion 84 is urged outwardly toward the front plate and held in that position by the leaf spring 88. This forces the terminal portion and the tip 86 to rest against the slot and engage the trailing edge of the slot 53 thereby preventing forward rotation of the disc when the slot 53 is empty.

Figure 10:
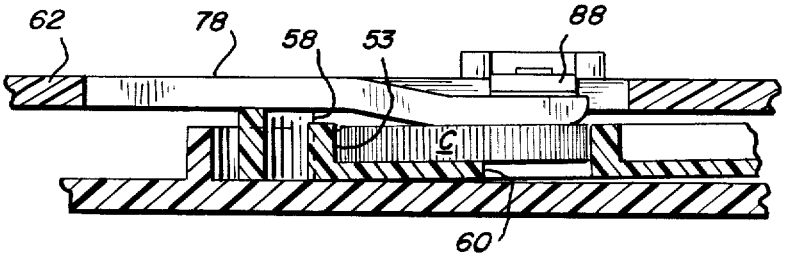
Figure 6:
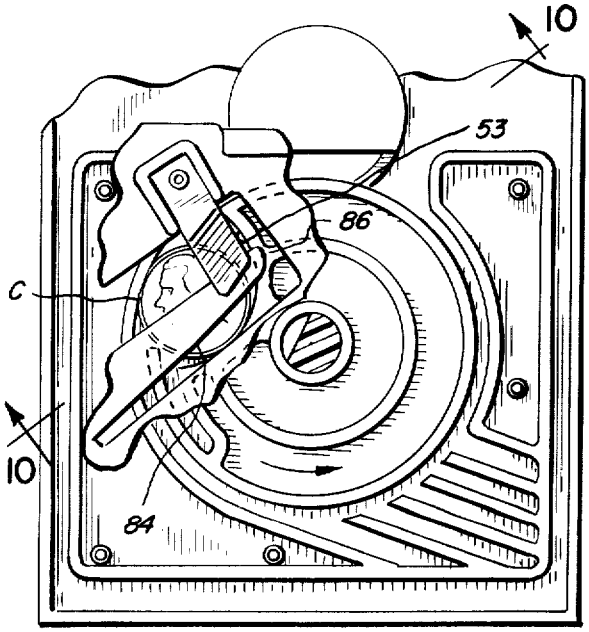
Figure 7:
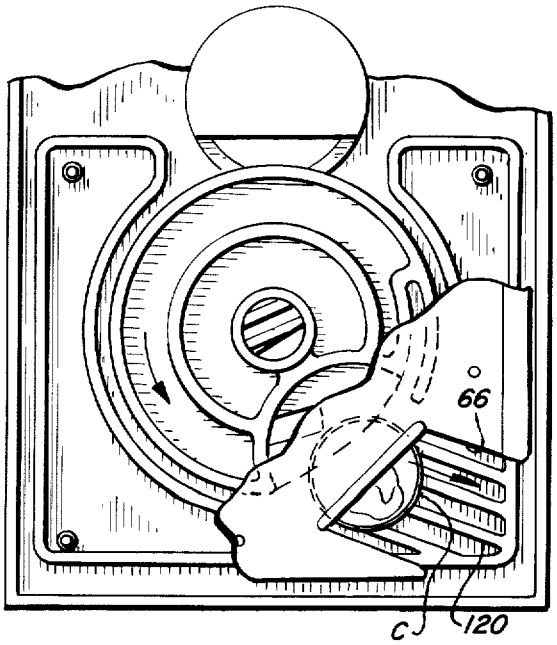

Referring now to FIGS. 6 and 10, when a coin C is in the pocket 53, the terminal portion 84 and tip 86 of the finger 78 engage the face of the coin and are urged inwardly toward the back plate. Thus as the disc 50 is rotated and the trailing edge of the coin-receiving slot reaches the tip 86, the tip rides up over the edge and onto the rib 61 thereby permitting rotation of the element 50. As the finger-like member 56 passes beneath the dog 78, the cam-like portion 59 engages the dog and as the disc is rotated the dog urges the finger 56 axially outwardly. This permits the disc to be rotated in the forward direction and thus the finger 56 does not interfere in the operation of the coin-receiving mechanism when it is being rotated in the forward direction.

At the discharge position, the cut-out portion 66 in the back plate and the sloped guide ribs 120 guide the coin C into a reservoir in the base 12. Rotation is continued until the disc 50 reaches the initial position, where the finger 56 is moved past the aperture edge 82, and then pops axially inwardly so as to be effective in preventing reverse rotation.

At the same time, one of the triangular slots in the dispensing disc 100 is rotated over the chute where the gumball in the slot drops into the chute to the discharge opening 14. It is to be noted that the gear ratio of the spur gear 92 to the gear teeth 108 is such that it requires three revolutions of the spur gear to obtain one complete revolution of the dispensing disc so that there is always one triangular slot in the dispensing position and at least one in the receiving position.

It will be appreciated that numerous changes and modifications can be made to the embodiment shown herein without departing from the spirit and scope of this invention.

What is claimed and desired to be secured by Letters Patent of the United States is:

1. A coin-operated article-dispensing machine, having a coin-receiving mechanism that permits operation of the mechanism when a coin is in the mechanism, and prevents operation of the mechanism when no coin is present, said coin-receiving mechanism including: front-plate means having a coin-receiving aperture; rotatable coin-receiving disc means adjacent said front-plate means and having pocket means therein for receiving coins inserted into said mechanism through said aperture; actuator means cooperatively associated with said disc for rotating said disc; means for preventing reverse rotation of said disc beyond a predetermined position; and means for selectively preventing forward rotation when no coin is in said pocket but permitting forward rotation when a coin is in said pocket, the improvement comprising said disc including integral peripheral finger means for cooperation in preventing reverse rotation of said disc, and having a terminal end portion which defines on axially-extending, abutment-shoulder means, said finger means being adapted to flex in the axial direction; and fixedly positioned shoulder defining means in axial relation to said disc and arranged for engagement by said abutment-shoulder means when said disc is rotated in the reverse direction, thereby preventing reverse rotation of said disc.

2. A machine as in claim 1 wherein said means for selectively preventing or permitting said forward rotation comprises dog means cooperatively positioned in fixed axial relation to said disc and said coin-receiving pocket so as to engage only a trailing edge portion of said pocket when no coin is therein thereby preventing forward rotation of said disc and said dog means being adapted to be disabled by a coin present in said pocket so as to permit forward rotation of said disc.

3. A machine as in claim 2 which includes back plate means having said dog means integral therewith, said plate means positioned adjacent said disc, and biasing means on said plate means for urging said dog means axially forwardly toward said disc.

4. A machine as in claim 1 wherein said pocket is of a size to receive coins of different sizes.

5. A machine as in claim 1, wherein said finger means is arcuately shaped.

6. A machine as in claim 5 which includes back plate means having means defining said reverse rotation preventing shoulder defining means.

7. A machine as in claim 6, wherein said back plate means has an aperture therein having an edge portion, said edge portion being said reverse rotation preventing shoulder means.

8. A machine as in claim 7, wherein said finger means include a tapering cam-like surface which tapers from the body of the disc to said abutment shoulder and which surface is arranged upon forward rotation of said disc to engage said back plate and thereby cause said finger to flex.

9. A coin-operated article-dispensing machine, having a coin-receiving mechanism that permits operation of the mechanism when a coin is in the mechanism, and prevents operation of the mechanism when no coin is present, said coin-receiving mechanism including: front-plate means having a coin-receiving aperture; rotatable coin-receiving disc means adjacent said front-plate means and having pocket means therein for receiving coins inserted into said mechanism through said aperture; actuator means cooperatively associated with said disc for rotating said disc; means for preventing reverse rotation of said disc beyond a predetermined position; and means for selectively preventing forward rotation when no coin is in said pocket but permitting forward rotation when a coin is in said pocket; the improvement comprising said disc including axially-extending, abutment-shoulder means for cooperation in preventing reverse rotation of said disc; and fixedly positioned shoulder defining means in axial relation to said disc and arranged for engagement by said abutment-shoulder means when said disc is rotated in the reverse direction, thereby preventing reverse rotation of said disc, wherein said disc includes integral arcuate peripheral finger means having a terminal end portion which defines said axially-extending, abutment-shoulder means, and a tapering cam-like surface which tapers from the body of the disc to said abutment shoulder, and said finger means being adapted to flex in the axial direction.

10. A machine as in claim 9, wherein said finger means taper axially inwardly and said shoulder means extend inwardly of said disc, so that when said disc is rotated in a reverse direction said finger abutment means engage said shoulder means to prevent said disc reverse rotation but when said disc is rotated in said forward direction the tapered portion of the finger is urged axially outwardly.

11. A coin operated article-dispensing machine, having a coin-receiving mechanism that permits operation of the mechanism when a coin is in the mechanism, and prevents operation of the mechanism when no coin is present, said coin-receiving mechanism including: front-plate means having a coin-receiving aperture; rotatable coin-receiving disc means adjacent said front-plate means and having pocket means therein for receiving coins inserted into said mechanism through said aperture; actuator means cooperatively associated with said disc for rotating said disc; means for preventing reverse rotation of said disc beyond a predetermined position; and means for selectively preventing forward rotation when no coin is in said pocket but permitting forward rotation when a coin is in said pocket; the improvement comprising said disc including axially extending, abutment-shoulder means for cooperation in preventing reverse rotation of said disc; and fixedly positioned shoulder defining means in axial relation to said disc and arranged for engagement by said abutment-shoulder means when said disc is rotated in the reverse direction, thereby preventing reverse rotation of said disc; wherein said means for selectively preventing or permitting said forward rotation comprises dog means cooperatively positioned in fixed axial relation to said disc and said coin-receiving pocket so as to engage only a trailing edge portion of said pocket when no coin is therein thereby preventing forward rotation of said disc and said dog means being adapted to be disabled by a coin present in said pocket so as to permit forward rotation of said disc; and which includes back plate means having said dog means integral therewith, said plate means positioned adjacent said disc, and biasing means on said plate means for urging said dog means axially forwardly toward said disc; and wherein said back plate means includes means defining an aperture having an edge portion, which edge portion comprises said reverse rotation preventing shoulder defining means.

12. A machine as in claim 11, wherein said disc means and said back plate means are of plastic.

* * * * *